US007686432B2

(12) United States Patent
Kim et al.

(10) Patent No.: US 7,686,432 B2
(45) Date of Patent: Mar. 30, 2010

(54) INKJET PRINTER HEAD AND FABRICATING METHOD THEREOF

(75) Inventors: Soon-Young Kim, Yongin-si (KR); Jae-Woo Joung, Suwon-si (KR); Won-Chul Sim, Seongnam-si (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 520 days.

(21) Appl. No.: 11/654,640

(22) Filed: Jan. 18, 2007

(65) Prior Publication Data

US 2007/0171259 A1 Jul. 26, 2007

(30) Foreign Application Priority Data

Jan. 20, 2006 (KR) ..... 10-2006-0006112

(51) Int. Cl.
*B41J 2/045* (2006.01)

(52) U.S. Cl. ..... 347/68

(58) Field of Classification Search ..... 347/68, 347/69–72; 400/124.16, 124.17
See application file for complete search history.

(56) References Cited

U.S. PATENT DOCUMENTS 6,447,107 B1 * 9/2002 Chino et al. ..... 347/71

FOREIGN PATENT DOCUMENTS

JP 10-119264 5/1998
JP 2000-127380 A 5/2000
JP 2002-292868 A 10/2002
JP 2004-209724 A 7/2004
JP 2005-81620 A 3/2005
JP 2005-161706 A 6/2005
JP 2005-212294 A 8/2005

OTHER PUBLICATIONS

Notice of Preliminary Rejection, Issued on Dec. 6, 2006 from the Korean Intellectual Property Office. (concerning Korean Patent Application 2006-0006112).
Japanese Office Action issued on Mar. 30, 2009 in corresponding Japanese Patent Application 2007-010196.
Chinese Office Action issued on Apr. 3, 2009 in corresponding Chinese Patent Application 200710000753.2.

* cited by examiner

*Primary Examiner*—K. Feggins

(57) ABSTRACT

An inkjet printer head and fabricating method thereof are disclosed. An inkjet printer head, which includes: a lower board, in which a nozzle part and a restrictor are formed; an upper board attached to an upper portion of the lower board, in which an ink chamber and an ink inlet are formed; and a piezoelectric element joined to a membrane of the upper board, where the membrane is formed by the portions remaining after portions of the upper board are removed to form the ink chamber, is formed by attaching two boards by an attachment method that does not use a separate adhesion material, such as anodic bonding, for a simple and easy attachment, and for a strong head structure in which there are no chemical or physical reactions that may occur in adhesion layers.

2 Claims, 10 Drawing Sheets

- PRIOR ART –

- PRIOR ART -

INKJET PRINTER HEAD AND FABRICATING METHOD THEREOF

CROSS-REFERENCE TO RELATED APPLICATIONS

This application claims the benefit of Korean Patent Application No. 10-2006-0006112 filed with the Korean Intellectual Property Office on Jan. 20, 2006, the disclosure of which is incorporated herein by reference in its entirety.

BACKGROUND

1. Technical Field

The present invention relates to a printer head, more particularly, to an inkjet printer head and a fabricating method thereof.

2. Description of the Related Art

Currently, there are ongoing attempts to apply inkjet techniques to a variety of fields, for example, the fields of biochips, metal wiring in PCB's, and color patterning in LCD's, etc. In thus applying inkjet techniques to new fields, the situation may arise where, unlike in the prior art of spraying low-viscosity ink drops on paper to form text or pictures, metal nanoparticles or highly viscous polymers, etc., are ejected onto a board of a special material.

Therefore, in order to apply inkjet techniques to several fields, the development of a suitable head is of critical importance. That is, the head should allow the ejection of ink droplets that are high in viscosity, it should provide high precision and frequency, it should not allow chemical reactions on the head structure caused by ink particles, and it should not allow the nozzles to be blocked. Thus, the development of an inkjet head is required that satisfies these conditions.

In general, inkjet printing is a technique of ejecting liquid ink onto paper for printing, where an inkjet print head has nozzles arranged that are about the size of a needlepoint, through which the ink is ejected. An inkjet printer can be grouped to the following types according to the method by which the ink is sprayed.

The bubble jet spray type ejects ink by using heating elements on the side wall of a minute tube to control the size of a bubble inside the nozzle. Increasing the heat on the heating elements creates a bubble inside the nozzle, where ink is sprayed when the bubble expands to its maximum size. When the heating of the heating elements is stopped after the spraying, the bubble disappears and the ink is replenished. Advantages of the bubble jet method are that it does not require an ink storage part, and that the sizes of the tubes and heating elements are very small, allowing a reduced size of the head. However, the bubble jet spraying method has the disadvantage that it is difficult to arrange the nozzles 2-dimensionally.

The thermal jet method is similar to the bubble jet type, but has a different position for the heating elements. That is, the thermal jet type has the heating elements arranged on the opposite or on the same side of the ink chamber as the nozzles, where ink is discharged by the vapor pressure created when the heated ink evaporates. The thermal jet type has the advantage that the arrangement of the heating elements and nozzles can be made 2-dimensional, so that the number of nozzles can be increased.

The piezoelectric spray type sprays ink by applying an impact from the rear side of the nozzle according to an inputted signal. A piezoelectric element, which changes shape according to an electric signal supplied as a driving power for ink ejection, is formed at an upper portion of the chamber where the ink is positioned. When a particular electric signal is supplied to deform the shape of the chamber, the ink surface at the end of the nozzle connected to the chamber is expanded, at which point the electric signal is controlled so as to abruptly pull back the ink surface, which causes the ink in front of the nozzle surface to be ejected due to inertia.

These inkjet printing techniques have been used mainly in the field of office automation (OA), and in marking packages and printing on clothing for industrial use, while application possibilities are gradually being extended with the development of functional ink, etc., that contains nano metal particles such as silver and nickel, etc.

However, while it is common in fabricating an inkjet printer head for ejecting ink or metallic or organic solvents, etc., to attach each plate member, such as for the membrane, chamber, ink storage part, and nozzles, etc., using adhesion layers, these adhesion layers are made of polymer materials, and are highly vulnerable to alcohol or other solvents used in ink. Also, as the plates are attached using several adhesion layers, the inkjet printer head is given a complicated composition and a complicated fabrication process.

That is, the conventional inkjet printer head, as illustrated in FIGS. 1 and 2, was fabricated by etching silicon boards, etc., and performing electrical plating to create the structure, or by mechanically processing stainless steel (SUS) and then stacking several layers. In the case of the prior art illustrated in FIG. 1, since the structure is formed by stacking, the numerous adhesion layers cause a reduced yield rate and a generally complicated process, and in the case of the prior art illustrated in FIG. 2, while there is an attempt to increase precision by the meticulous processing of a silicon board, the use of metal plating may induce foreign substances, and the adhesion layers may be vulnerable to ink.

SUMMARY

Certain aspects of the present invention aim to provide an inkjet printer head and fabricating method thereof, in which the inkjet printer head is fabricated by attaching two boards, to provide a simple process, easy adhesion, and a strong structure that does not have adhesion layers that are separated by chemical or physical reactions.

One aspect of the invention provides an inkjet printer head, which includes: a lower board, in which a nozzle part and a restrictor are formed; an upper board attached to an upper portion of the lower board, in which an ink chamber and an ink inlet are formed; and a piezoelectric element joined to a membrane of the upper board, where the membrane is formed by the portion remaining after a portion of the upper board is removed to form the ink chamber.

It may be desirable that the lower board be a silicon board, the upper board be a glass board, and that the lower board and the upper board be attached by anodic bonding. The membrane may be formed by removing a portion of the glass board with a sandblaster to form an ink chamber.

The glass board may be formed by attaching a second glass board onto an upper portion of a first glass board, and the membrane may be formed by perforating a portion of the first glass board, attaching the second glass board, and then polishing the second glass board.

The straight part of the nozzle part and the restrictor may be formed by etching the silicon board by ICP RIE. The slope part of the nozzle part may be formed by anisotropic etching.

Another aspect of the invention provides a method of fabricating an inkjet printer head, which includes: forming a nozzle part and a restrictor in a lower board and forming an ink chamber and an ink inlet in an upper board; joining the lower board onto an upper portion of the lower board; and joining a piezoelectric element onto a membrane of the upper board, where the membrane is formed by the portion remaining after a portion of the upper board is removed to form the ink chamber.

It may be desirable that the lower board be a silicon board, the upper board be a glass board, and that the joining of the lower board be performed by anodic bonding. The ink chamber may be formed by removing a portion of the glass board with a sandblaster.

The forming may include perforating portions of a first glass board to form the ink chamber; attaching a second glass board onto an upper portion of the first glass board; and polishing the second glass board to form the membrane.

The forming may include etching a lower surface of the silicon board to form a straight part of the nozzle part and etching an upper surface of the silicon board to form the restrictor; and etching an upper surface of the silicon board in correspondence with the straight part of the nozzle part to form a slope part of the nozzle part. The etching for forming the straight part and for forming the restrictor may be performed by ICP RIE, while the etching for forming the slope part may be performed by anisotropic etching.

Additional aspects and advantages of the present invention will become apparent and more readily appreciated from the following description, including the appended drawings and claims, or may be learned by practice of the invention.

DETAILED DESCRIPTION

Embodiments of the invention will be described below in more detail with reference to the accompanying drawings. In the description with reference to the accompanying drawings, those components are rendered the same reference number that are the same or are in correspondence regardless of the figure number, and redundant explanations are omitted.

Figure 1:
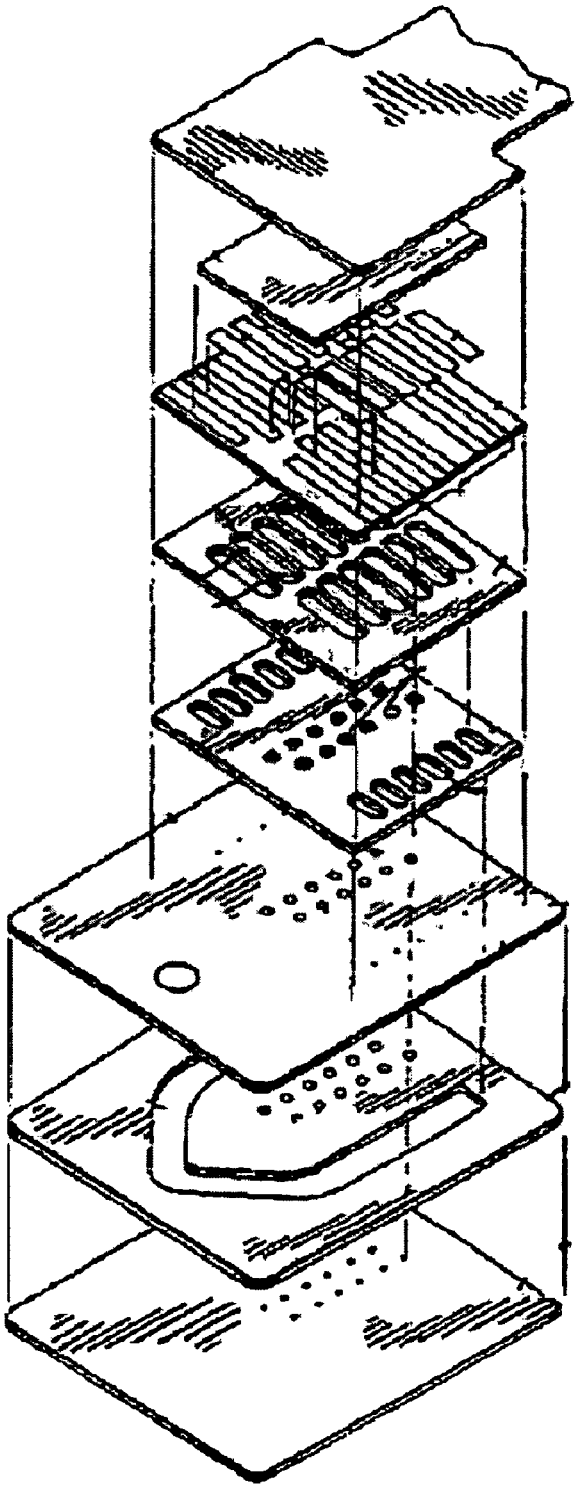
FIG. 1 is an exploded perspective view illustrating the structure of an inkjet printer head according to prior art.
Figure 2:
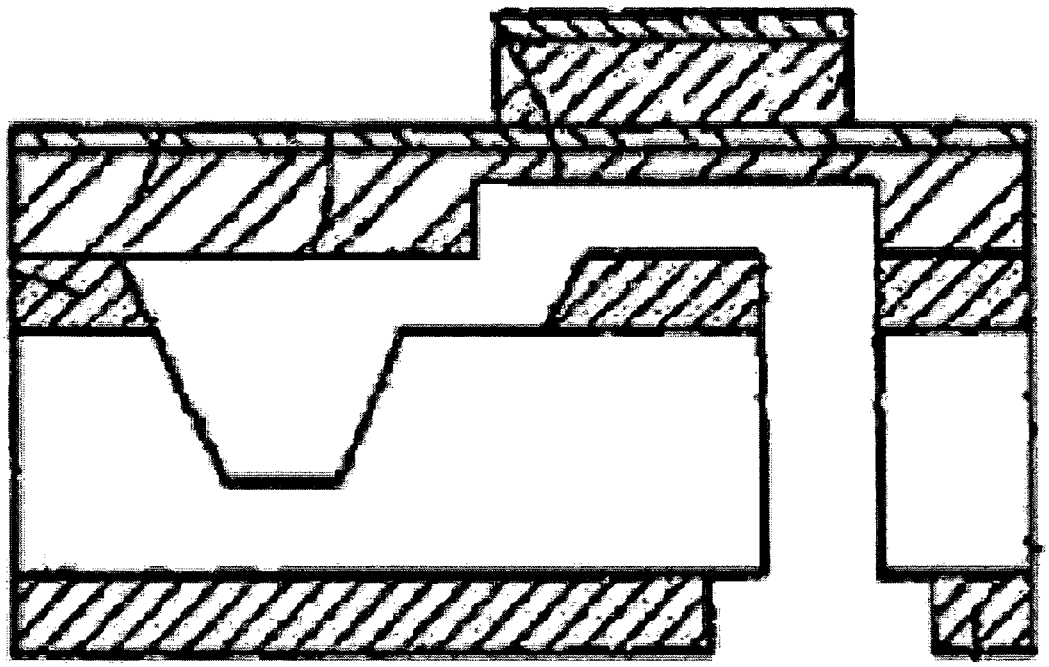
FIG. 2 is a cross-sectional view illustrating the structure of an inkjet printer head according to prior art.
Figure 3:
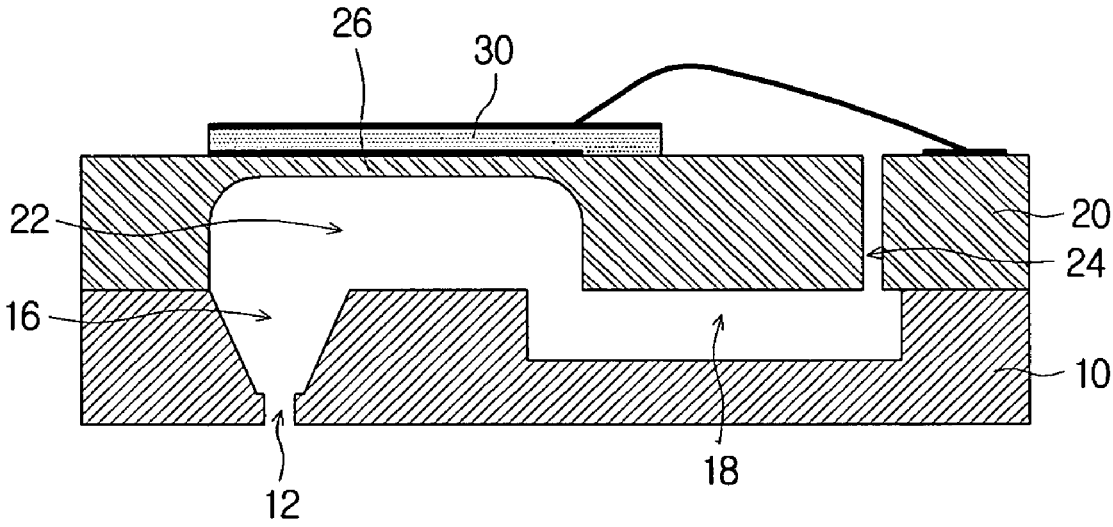
FIG. 3 is a cross-sectional view illustrating the structure of an inkjet printer head according to a first disclosed embodiment of the invention.
Figure 4:
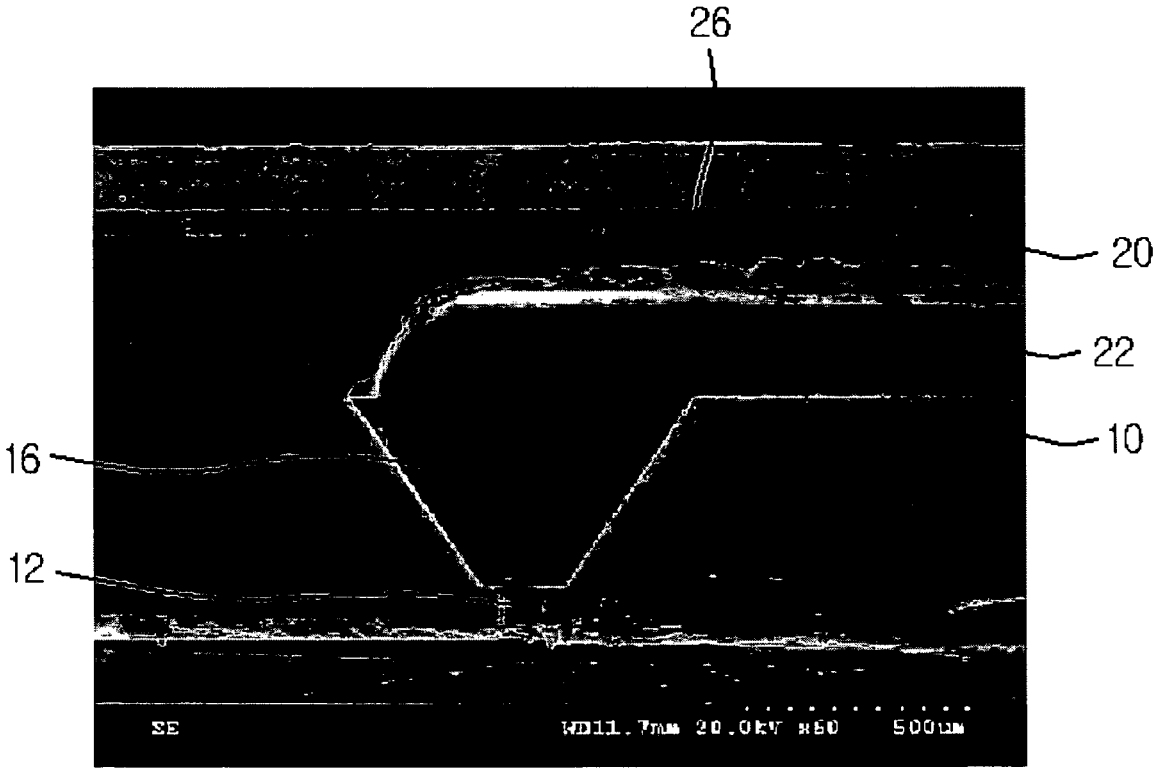
FIG. 4 is a photograph of a cross section of the nozzle part in an inkjet printer head according to a first disclosed embodiment of the invention.
Figure 5:
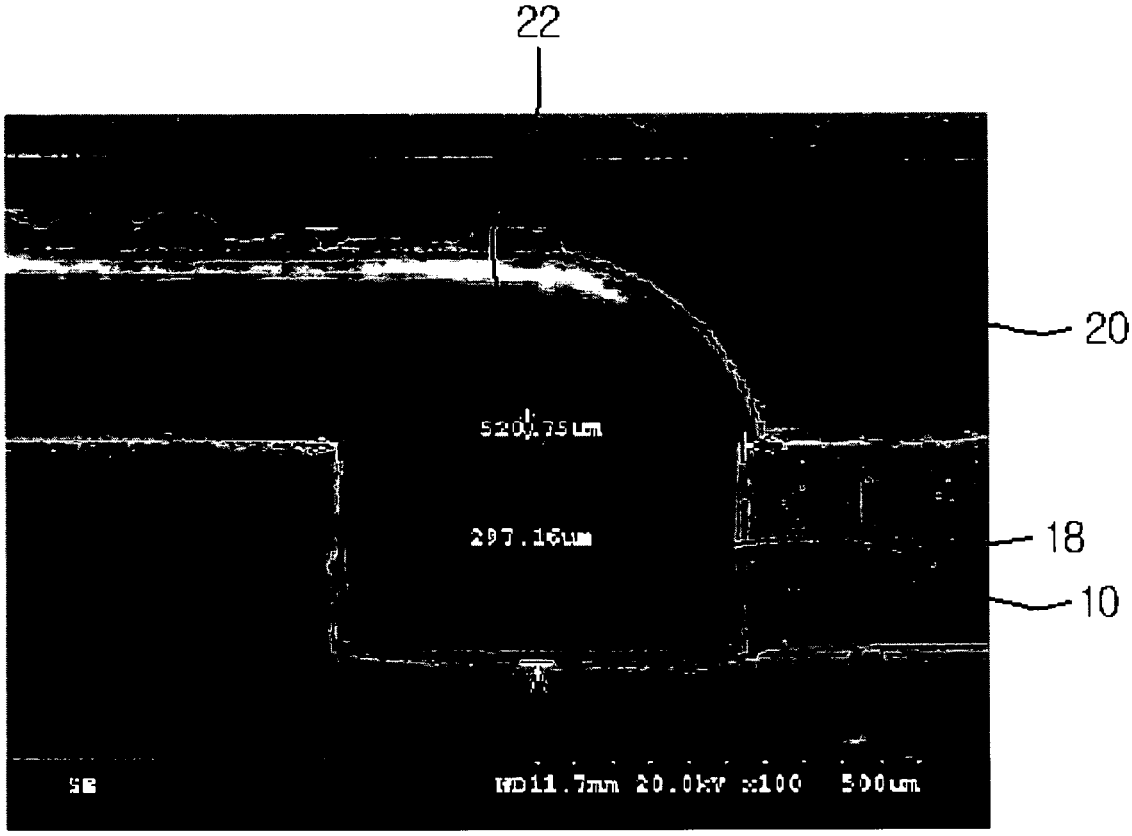
FIG. 5 is a photograph of a cross section of the restrictor in an inkjet printer head according to a first disclosed embodiment of the invention.
Figure 6:
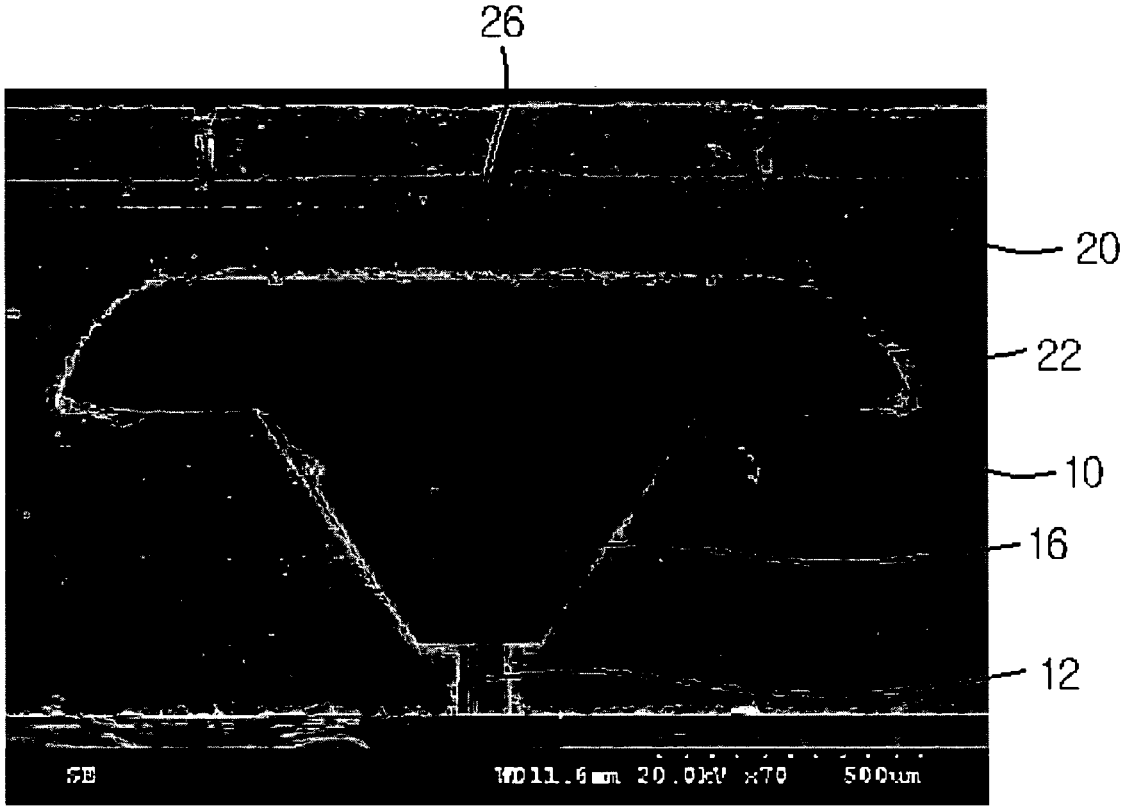
FIG. 6 is a photograph of a cross section of the ink chamber and nozzle part in an inkjet printer head according to a first disclosed embodiment of the invention.

FIG. 3 is a cross-sectional view illustrating the structure of an inkjet printer head according to a first disclosed embodiment of the invention, FIG. 4 is a photograph of a cross section of the nozzle part in an inkjet printer head according to the first disclosed embodiment of the invention, FIG. 5 is a photograph of a cross section of the restrictor in an inkjet printer head according to the first disclosed embodiment of the invention, and FIG. 6 is a photograph of a cross section of the ink chamber and nozzle part in an inkjet printer head according to the first disclosed embodiment of the invention. In FIGS. 3 to 6 are illustrated a silicon board 10, a straight part 12 of a nozzle part, a slope part 16 of the nozzle part, a restrictor 18, a glass board 20, an ink chamber 22, an ink inlet 24, a membrane 26, and a piezoelectric element 30.

An aspect of the invention is to form an inkjet printer head, not by stacking several boards as in prior art, but by attaching two boards of an upper board and a lower board, for an easier fabrication of the inkjet printer head, and by attaching the boards by anodic bonding, without a separate adhesion layer, to prevent physical or chemical reactions that may occur at the adhesion layer.

As such, the basic composition of the inkjet printer head according to an aspect of the invention includes a lower board, and an upper board attached to an upper portion of the lower board, where a piezoelectric element 30 is joined to the upper board. The piezoelectric element 30, such as that used in a piezoelectric type inkjet printer head, is supplied with electric power to apply vibration on the membrane 26 and transfer the driving power for the inkjet printer head, and thus is joined to the membrane 26 portion from among the structures of the head.

An aspect of the invention is to readily form an inkjet printer head structure using only two boards, where among the inkjet printer head structures, the nozzle part and the restrictor 18 are formed in the lower board, and the ink chamber 22 and the ink inlet 24 are formed in the upper board, with the upper board and the lower board attached to form the overall head structure. However, the head structures formed respectively in the upper board and lower board are intended for easier fabrication, according to the fabrication process applied, and it is to be appreciated that the invention is not necessarily limited to forming the above structures in the upper board and lower board, respectively, and that other structures may be formed in each board within a range apparent to those skilled in the art.

The membrane 26 portion of the upper board, to which the piezoelectric element 30 is joined, is not a separate structure that is joined to the upper board, but rather the membrane 26 is formed from the remaining portion, when a portion of the upper board is removed, by etching, etc., to form the ink chamber 22.

To easily fabricate an inkjet printer head by thus processing and attaching two boards, it may be desirable that the lower board be a silicon board 10 and the upper board be a glass board 20, and that the attachment between the upper board and the lower board be achieved by anodic bonding. Anodic bonding is a technique of joining boards by means of ionic bonds between a glass and a silicon board, and since the boards can be attached without a separate adhesion layer interposed in-between, physical or chemical reactions due to the ink may be avoided that occur at an adhesion surface, and a strong head structure may be formed.

When forming the upper board with a glass board 20, the ink chamber 22 is formed by removing a portion of the glass board 20 with a sandblaster or by an isotropic etching process, where the remaining portion after forming the ink chamber 22 becomes the membrane 26, as described above.

The sandblasting process is a technique of spraying SiC particles to perform mechanical etching. Using this technique to etch the glass board 20, the ink chamber 22 may be shaped to have rounded edge portions, as illustrated in FIGS. 3 to 6, to provide structural stability with respect to vibrations applied by the piezoelectric element, lower risk of bubbles occurring in the ink held in the ink chamber 22, and greater stability in the flow of the ink. When the ink chamber 22 is formed by this sandblasting process, it is possible to adjust the amount of sandblaster, to readily adjust the depth of the ink chamber 22 and the thickness of the membrane 26.

However, the invention is not necessarily limited to forming an ink chamber 22 by applying a sandblasting process to the glass board 20, and it is to be appreciated that the ink chamber may be formed by etching the glass board 20 using other processes within a range apparent to those skilled in the art.

In the glass board, i.e. the upper board, the ink chamber 22 is formed, as described above, to form the membrane 26, and the ink inlet 24 is perforated. In the silicon board 10, i.e. the lower board, the straight part 12 of the nozzle part, the slope part 16 of the nozzle part, and the restrictor 18 are formed by a method apparent to those skilled in the art. Generally, in the case of structures such as the straight part 12 of the nozzle part and the restrictor 18, for which the silicon board 10 is etched straight in a particular direction, an ICP RIE (inductive coupled plasma reactive ion etching) process is applied, while in the case of structures such as the slope part 16 of the nozzle part, which has a certain slope, an anisotropic etching process is applied. However, it is to be appreciated that the invention is not limited to the above processes in the methods of etching the silicon board 10.

The glass board 20 and silicon board 10, in which the various structures have been formed, are attached by bipolar bonding, i.e. anodic bonding, to complete the head. With respect to the anodic bonding, in embodiments of the invention, the path starting from the ink inlet 24, passing through the restrictor 18 and the ink chamber 22, and leading to the nozzle part, is all connected, and is naturally open to the atmosphere.

In general, the anodic bonding process is performed within a temperature range of about 300 degrees to 500 degrees, so that when the inside of the inkjet printer head is sealed, deformations may occur in the membrane 26 during the cooling process after the adhesion. However, in the case of the inkjet printer head according to embodiments of the invention, the anodic bonding is performed while the internal structure of the head is open to the atmosphere, as described above, and thus there are no deformations in the membrane 26, and a stable attachment may be achieved.

Referring to FIGS. 4 to 6, which are photographs of the internal structure of an inkjet printer head thus formed, it can be seen that the glass board 20, i.e. the upper board, and the silicon board 10, i.e. the lower board, are attached as a single body without a separate adhesion layer, and that the shapes of the ink chamber 22 and the membrane 26 are evenly formed.

Figure 7:
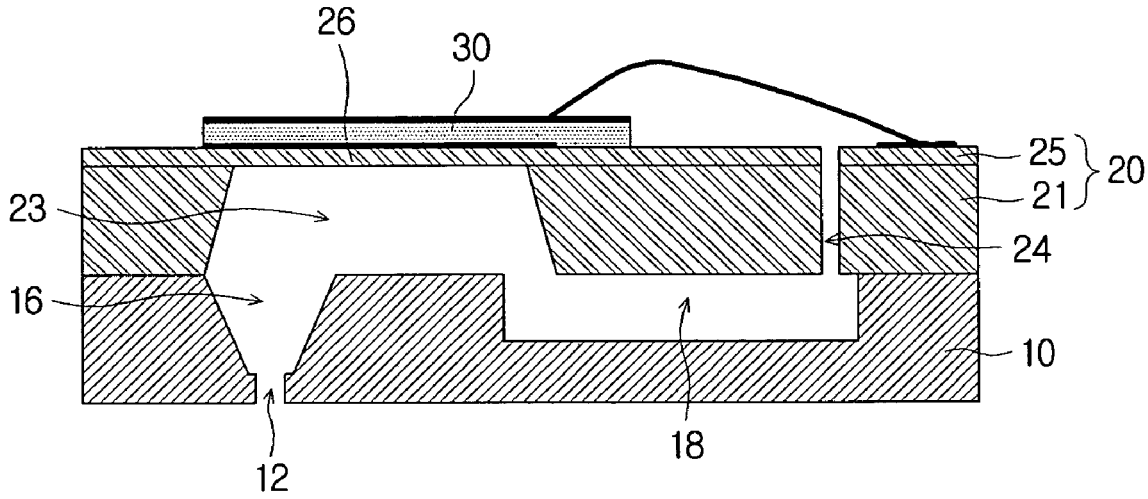
FIG. 7 is a cross-sectional view illustrating the structure of an inkjet printer head according to a second disclosed embodiment of the invention.

FIG. 7 is a cross-sectional view illustrating the structure of an inkjet printer head according to a second disclosed embodiment of the invention. In FIG. 7 are illustrated a silicon board 10, a straight part 12 of a nozzle part, a slope part 16 of the nozzle part, a restrictor 18, a glass board 20, a first glass board 21, an ink chamber 23, an ink inlet 24, a second glass board 25, a membrane 26, and a piezoelectric element 30.

While in the first disclosed embodiment, the membrane 26 is formed by etching the upper board to form the ink chamber 22, the second disclosed embodiment differs from the first disclosed embodiment in that the membrane 26 is formed by perforating the upper board to form the ink chamber 23, attaching another glass board on top, and then polishing it to an appropriate thickness.

That is, in the second disclosed embodiment, the glass board 20, which is the upper board, is formed as a second glass board 25 is attached onto an upper portion of a first glass board 21, and the membrane 26 is formed by perforating the first glass board 21 to form the ink chamber 23, and then attaching a second glass board 25 thereon and polishing to an appropriate thickness.

Whereas in the first disclosed embodiment, the depth of the ink chamber 22 and the thickness of the membrane 26 are adjusted by adjusting the amount of sandblaster applied on the glass board 20, in the second disclosed embodiment, the depth of the ink chamber 23 is adjusted by the thickness of the first glass board 21, and the thickness of the membrane 26 is adjusted by adjusting the amount of polishing of the second glass board 25.

The structures such as the straight part 12 of the nozzle part, the slope part 16 of the nozzle part, and the restrictor 18, etc., formed on the silicon board 10, i.e. the lower board, may be formed as in the first disclosed embodiment by etching methods such as ICP RIE and anisotropic etching, etc.

Figure 8:
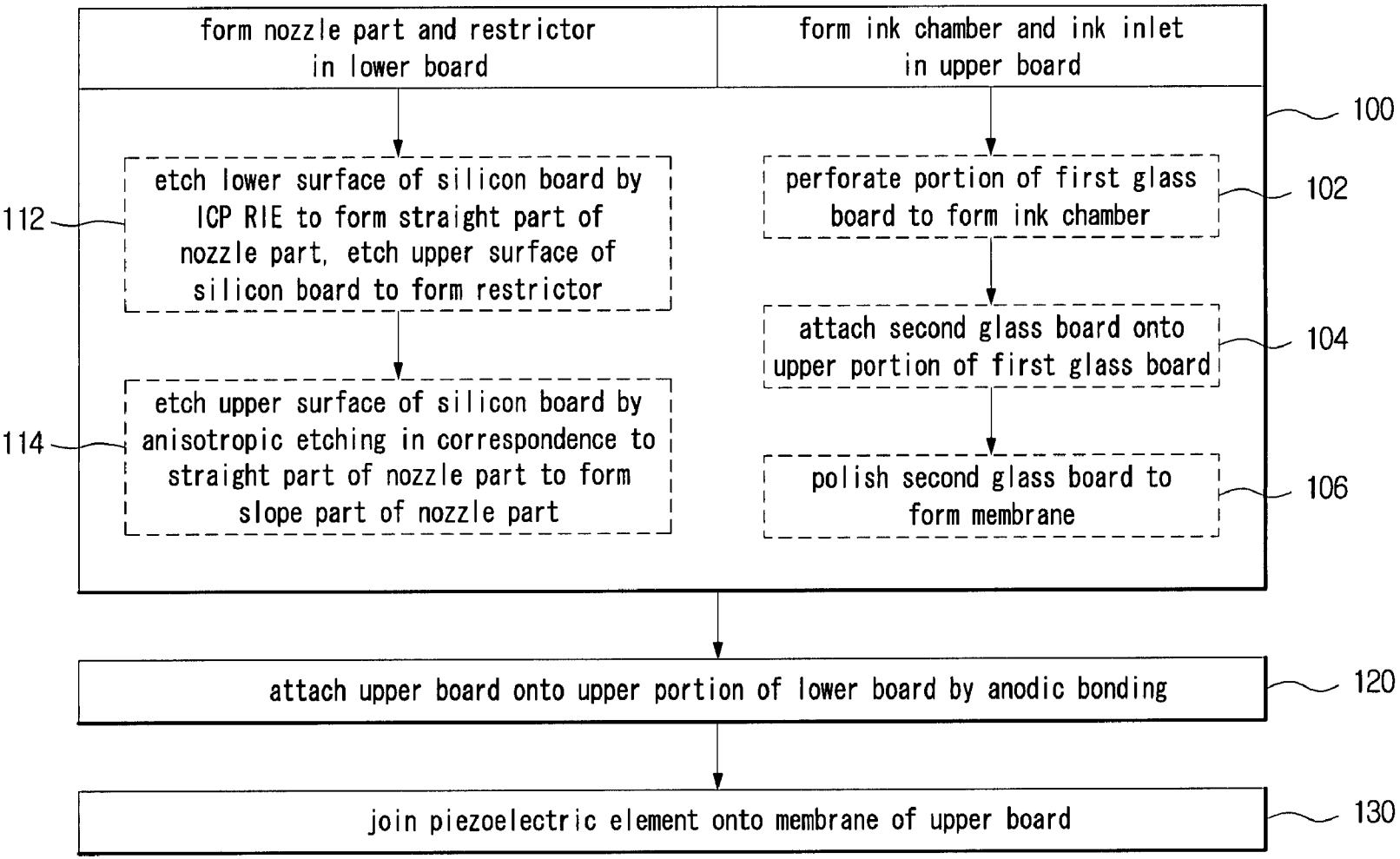
FIG. 8 is a flowchart illustrating a method of fabricating an inkjet printer head according to an embodiment of the invention.

FIG. 8 is a flowchart illustrating a method of fabricating an inkjet printer head according to an embodiment of the invention.

In order to readily fabricate a strong inkjet printer head by forming head structures in two boards and attaching them by anodic bonding, as in this embodiment, the nozzle part and the restrictor 18 are first formed in the silicon board 10, i.e. the lower board, and then the ink chamber 23 and the ink inlet 24 are formed in the glass board 20, i.e. the upper board (100).

A common sandblasting process may be applied on the glass board 20 so as to remove certain portions to form the ink chamber 22 and allow the remaining portions to be the membrane 26, or as described above, a portion of the first glass board 21 may be perforated to form the ink chamber 23 (102), a second glass board 25 may be attached thereon (104), and then the second glass board 25 may be polished to form the membrane 26 (106).

Forming the ink chamber 22 by a sandblasting process allows the edges of the ink chamber 22 to be formed in rounded curves, thereby providing structural stability with respect to the vibration applied by the piezoelectric element and providing a stable flow of ink. Also, forming the ink chamber 23 and membrane 26 by attaching the second glass board 25 onto the first glass board 21 and then polishing provides the advantage that it is possible to observe the inside of the ink chamber 23 through the membrane 26, which is a transparent glass board. Thus observing the inside of the ink chamber 23 to inspect the presence of bubbles in the ink may be used as reference in designing the flow path of the inkjet printer head.

Meanwhile, for the silicon board 10, which is the lower board, a straight etching method such as ICP RIE is used to etch the lower surface of the silicon board 10 for forming the straight part 12 of the nozzle part, and etch the opposite surface for forming the restrictor 18 (112). On the opposite surface of the silicon board 10 to the portion where straight part 12 of the nozzle part has been formed, the slope part 16 of the nozzle part is formed by a directional etching method, such as anisotropic etching, etc. (114).

The glass board 20 and silicon board 10, in which these various structures have been formed, are attached by anodic bonding (120), and the piezoelectric element 30 is joined to the membrane 26 of the upper board (130) to complete the inkjet printer head.

Figure 9:
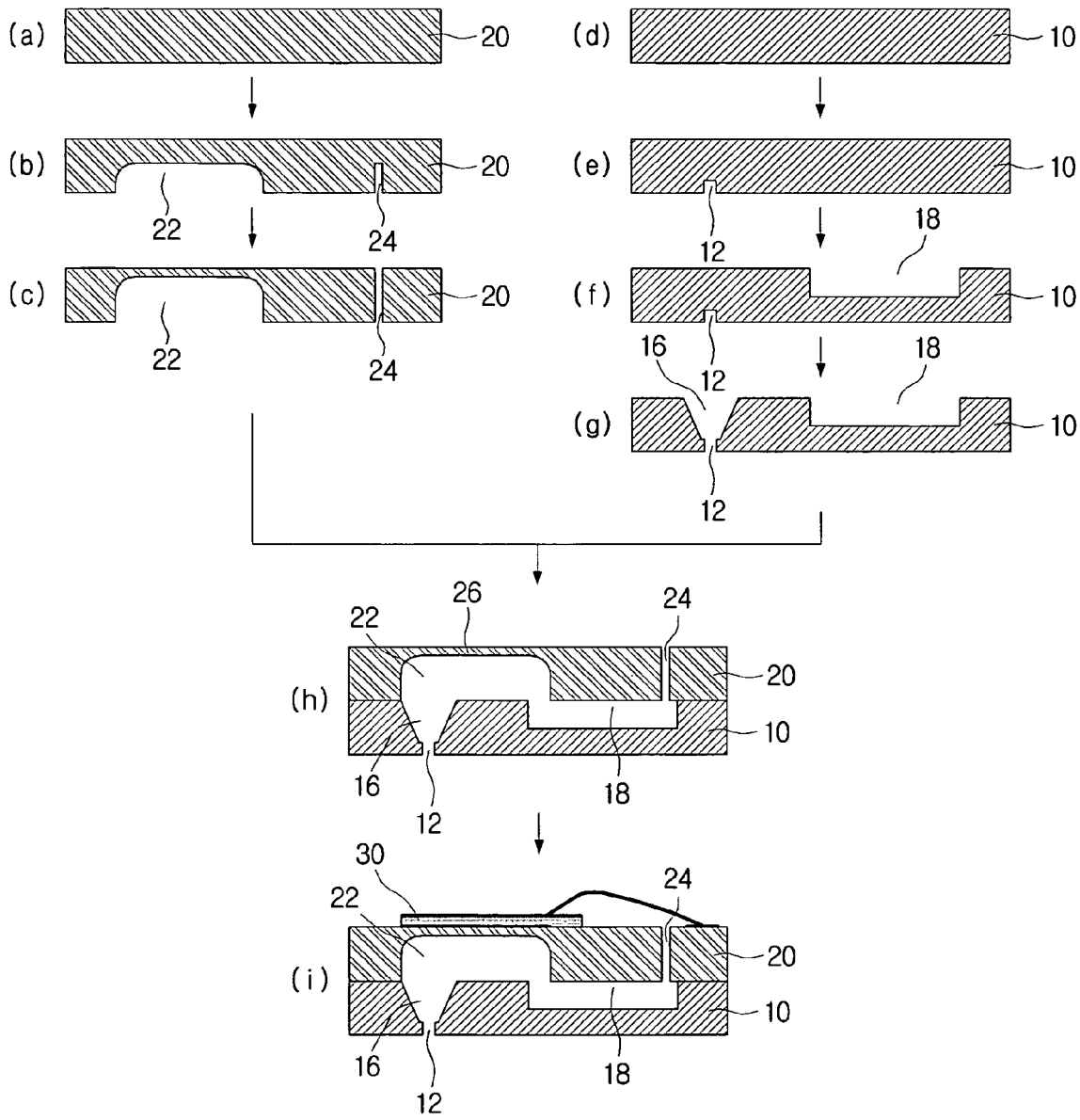
FIG. 9 is a flow diagram illustrating a process of fabricating an inkjet printer head according to a first disclosed embodiment of the invention.

FIG. 9 is a flow diagram illustrating a process of fabricating an inkjet printer head according to the first disclosed embodiment of the invention. In FIG. 9 are illustrated the silicon board 10, the straight part 12 of the nozzle part, the slope part 16 of the nozzle part, the restrictor 18, the glass board 20, the ink chamber 22, the ink inlet 24, the membrane 26, and the piezoelectric element 30.

As illustrated in FIG. 9, a fabrication process for an inkjet printer head according to the first disclosed embodiment of the invention includes, first, forming the operating part, such as the ink chamber 22 and membrane 26, etc., in the glass board 20, as in (a) through (c) of FIG. 9, and forming the nozzle and restrictor 18 in the silicon board 10, as in (d) through (g) of FIG. 9. The processing of the glass board 20 and the processing of the silicon board 10 may be performed in parallel, regardless of which is performed first.

Regarding the process of forming structures in the glass board 20, i.e. the upper board, a glass board 20 such as that in (a) of FIG. 9 is prepared, to which a sandblasting process is applied, as in (b) through (c) of FIG. 9, to form the ink chamber 22 and ink inlet 24. The portions remaining after forming the ink chamber 22 becomes the membrane 26, and thus it is possible to adjust the thickness of the membrane 26 by means of the amount of etching by the sandblaster.

Regarding the process of forming structures in the silicon board 10, i.e. the lower board, a silicon board 10 such as that in (d) of FIG. 9 is prepared, in which the straight part 12 of the nozzle part is formed, as in (e) of FIG. 9, and the restrictor 18 is formed, as in (f) of FIG. 9. Structures such as the straight part 12 of the nozzle part and the restrictor 18 are formed by a straight etching method, such as ICP RIE. As in (g) of FIG. 9, anisotropic etching is applied to form the slope part 16 of the nozzle part, which has a certain slope.

Next, the glass board 20 and silicon board 10, in which the various structures have been formed, are attached by anodic bonding, as in (h) of FIG. 9, to form a head having a solid structure that does not require a separate adhesion layer, and the piezoelectric element 30 is attached onto the membrane 26 formed in the glass board 20, to complete the fabrication of the head. The anodic bonding induces ionic bonding between materials, thereby preventing the leakage of fluids at the attachment portions and providing a physically and chemically stable attachment.

Figure 10:
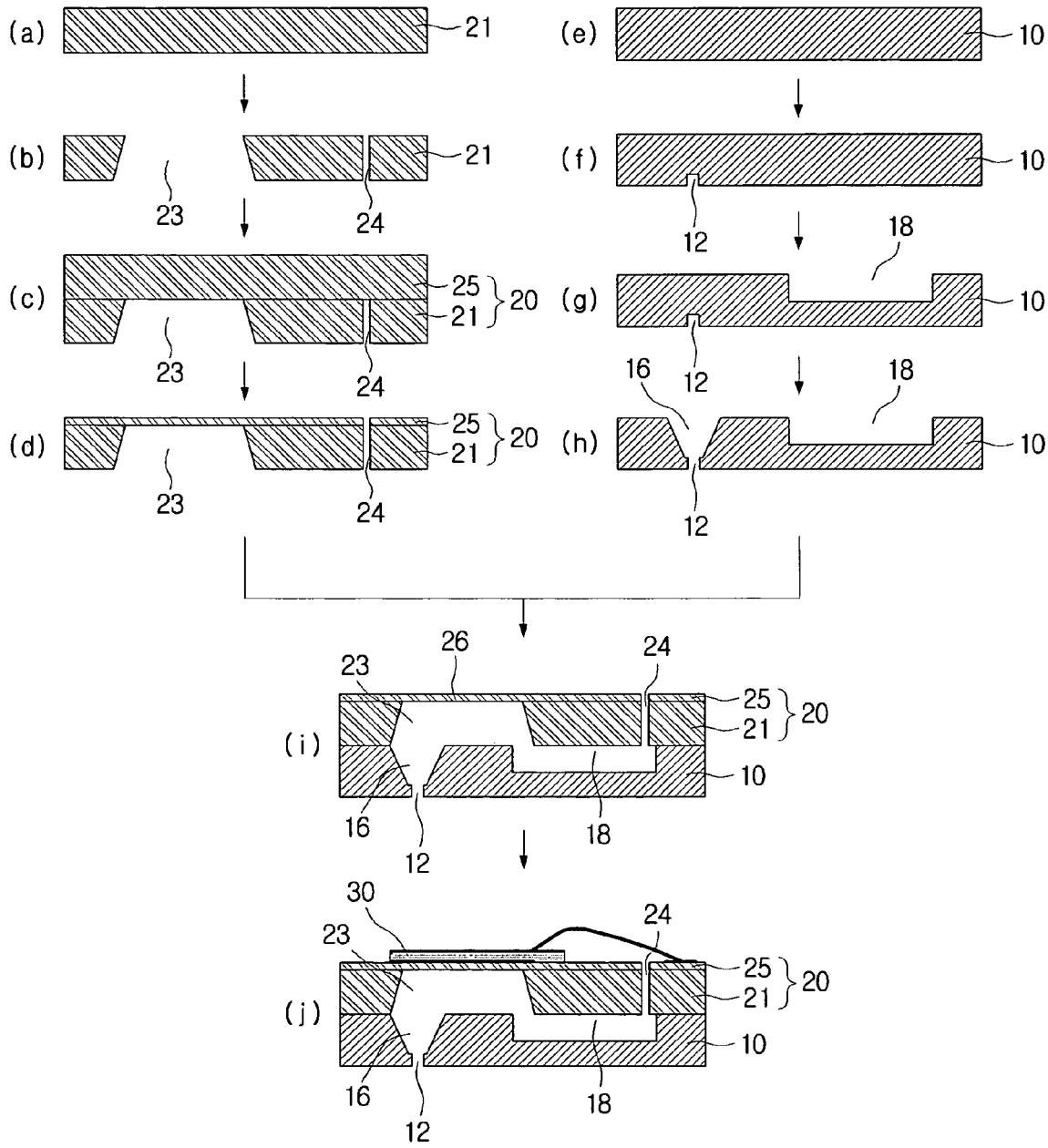
FIG. 10 is a flow diagram illustrating a process of fabricating an inkjet printer head according to a second disclosed embodiment of the invention.

FIG. 10 is a flow diagram illustrating a process of fabricating an inkjet printer head according to the second disclosed embodiment of the invention. In FIG. 10 are illustrated the silicon board 10, the straight part 12 of the nozzle part, the slope part 16 of the nozzle part, the restrictor 18, the glass board 20, the first glass board 21, the ink chamber 23, the ink inlet 24, the second glass board 25, the membrane 26, and the piezoelectric element 30.

The second disclosed embodiment differs from the first disclosed embodiment in the method of forming the membrane 26 in the upper board. In a first glass board 21, such as that in (a) of FIG. 10, a sandblasting process is applied to perforate the ink chamber 23 and ink inlet 24, as in (b) of FIG. 10.

Next, as in (c) of FIG. 10, the second glass board 25, which is to become the membrane 26, is attached onto an upper portion of the first glass board 21. As the first glass board 21 and the second glass board 25 are attached in a high-temperature environment, with a certain degree of melting at the interface, the two sheets of glass board are formed almost as a single-body structure made of a single material.

Next, as in (d) of FIG. 10, the second glass board 25 is polished to form the membrane 26. The thickness of the membrane 26 is adjusted by the amount of polishing. While in the first disclosed embodiment, it is difficult to observe the inside of the ink chamber 22 because the membrane 26 has a rough surface and is thus made opaque, in the second disclosed embodiment where a separate board is attached and polished to form the membrane 26, the membrane 26 is transparent, and the fluid inside the ink chamber 23 may advantageously be observed.

The procedures for processing the silicon board, i.e. the lower board, is similar to those of the first disclosed embodiment, where as in (e) through (h) of FIG. 10, the straight part 12 of the nozzle part and the restrictor 18 are formed by an ICP RIE process, and the slope part 16 of the nozzle part is formed by anisotropic etching. Next, the glass board 20 and silicon board 10, in which the structures have been formed, are attached by anodic bonding as in (i) of FIG. 10, and the piezoelectric element 30 is attached to the membrane 26, as in (j) of FIG. 10, to complete the fabrication of the inkjet printer head.

According to aspects of the invention as set forth above, an inkjet printer head is formed by attaching two boards by an attachment method that does not use a separate adhesion material, such as anodic bonding, for a simple and easy attachment, and for a strong head structure in which there are no chemical or physical reactions that may occur in adhesion layers.

Also, as the upper structure of the inkjet printer head is formed of a glass board, the inside of the ink chamber 23 may readily be observed from the exterior, whereby the flow of an ink fluid may be analyzed.

While the present invention has been described with reference to the particular embodiments set forth above, it is to be appreciated that various changes and modifications may be made by those skilled in the art without departing from the spirit and scope of the present invention, as defined by the appended claims and their equivalents.

What is claimed is:

1. An inkjet printer head, comprising:

a lower board having a nozzle part and a restrictor formed therein;

an upper board attached to an upper portion of the lower board and having an ink chamber and an ink inlet formed therein; and a piezoelectric element joined to a membrane of the upper board, wherein the membrane is formed, after a portion of the upper board is removed to form the ink chamber, by the remaining portion, and wherein the upper board is a glass board formed by attaching a second glass board onto an upper portion of a first glass board, and the membrane is formed by perforating a portion of the first glass board, attaching the second glass board, and then polishing the second glass board.

2. The inkjet printer head of claim 1, wherein the lower board is a silicon board and the upper board are attached by anodic bonding.

* * * * *